US005778812A

United States Patent [19]

Nishikawa

[11] Patent Number: 5,778,812

[45] Date of Patent: Jul. 14, 1998

[54] SEWING APPARATUS FOR SEWING CIRCULAR RIB

[75] Inventor: Masahiko Nishikawa, Osaka, Japan

[73] Assignee: Pegasus Sewing Machine Mfg. Co., Ltd., Osaka, Japan

[21] Appl. No.: 855,525

[22] Filed: May 13, 1997

[30] Foreign Application Priority Data

May 15, 1996 [JP] Japan ..... 8-146593

[51] Int. Cl.[6] ..... D05B 35/06

[52] U.S. Cl. ..... 112/470.33

[58] Field of Search ..... 112/470.33, 470.29, 112/470.31, 470.32, 305, 306, 152, 153

[56] References Cited

U.S. PATENT DOCUMENTS

| | | | |
|---|---|---|---|
| 4,947,771 | 8/1990 | Miyachi et al. | 112/470.29 X |
| 5,131,336 | 7/1992 | Kono et al. | 112/470.33 X |
| 5,269,239 | 12/1993 | Adamski, Jr. et al. | 112/470.33 X |
| 5,522,332 | 6/1996 | Price et al. | 112/470.29 |
| 5,570,647 | 11/1996 | Adamski, Jr. et al. | 112/470.31 |
| 5,657,711 | 8/1997 | Price et al. | 112/470.33 |

*Primary Examiner*—Ismael Izaguirre

*Attorney, Agent, or Firm*—Jones, Tullar & Cooper, P.C.

[57] ABSTRACT

A sewing apparatus of circular rib of the invention is applied to the case of sewing a circular rib in a tape form to the end portion of a tubular cloth such as the waist portion of briefs. A first cloth end controlling device corrects the position by gripping the end portion of a tubular cloth C between a control roller 23 and a roller holder 25 so as to support an circular rib R and tubular cloth C separately at right and left side, in a front roller 1, out of plural rollers 1, 2, 3 disposed in front and rear of the needle drop point 5 of a sewing machine. A second cloth end controlling device corrects the position by gripping the end portion of the tubular cloth C between the control roller 22 and roller holder 24, so that the end portion may overlap with the circular rib R. Moreover, near the second cloth end controlling device, a rib detaching guide 4 supports only the circular rib R, and moves away to a waiting position along with approach of the sewing start portion. In this constitution, without having to stop the sewing machine temporarily, the both pieces R and C can be sewn together accurately and efficiently.

4 Claims, 5 Drawing Sheets

SEWING APPARATUS FOR SEWING CIRCULAR RIB

BACKGROUND OF THE INVENTION

1. Field of the Invention

The present invention relates to a sewing apparatus of circular rib applied in automatic sewing of circular rib in a tape form by a sewing machine at the end portion of a tubular cloth, for example, in the waist portion of briefs, and more particularly to a sewing apparatus of circular rib for applying and setting a circular rib on plural rollers disposed in the front and rear of the needle drop point of a sewing machine in a state of passing through the needle drop point, setting a tubular cloth on the plural rollers, operating the sewing machine in this state, and thereby sewing while correcting the position of the end portion of the tubular cloth to the circular rib.

2. Description of the Prior Art

In sewing of circular rib of this kind, hitherto, by operating the sewing machine by generally setting the tubular cloth so that its end may overlap with the end portion of the circular rib at the needle drop point of the sewing machine, the end portions of the tubular cloth and the circular rib are sewn while aligning mutually.

As the sewing apparatus of circular rib employed in such sewing work, the constitution as disclosed in Japanese Laid-open Patent 4-161190 was conventionally known. In the published sewing apparatus of circular rib, the circular rib and tubular cloth are set as follows. That is, as shown in FIG. 7, a circular rib R is stretched to the girth dimension of the tubular cloth C, and the circular rib R is set on plural rollers 101, 102, 103, so that its end portion may run along a virtual sewing line SL passing through a needle drop point 100 of the sewing machine. The circular rib R may pass over a guide plate 105 disposed opposite to a cutter 104 so as not to be cut by the cutter 104. The cutter 104 for cutting and aligning the tubular cloth end portion is composed of a fixed blade 104*a* and a movable blade 104*b* disposed in front of the needle drop point 100. On the other hand, the tubular cloth C is wound on the rear roller 103 together with the circular rib R in the portion from the position of the needle drop point 100 to the rear side, and the tubular cloth C is merely applied and set on a cover 107 having a cloth end control roller 106, without being stretched to the girth dimension, so that its front portion to the needle drop point 100 may be fed into the needle drop point 100 through the under side of the front rollers 101, 102. An end portion of the tubular cloth C may pass under the guide plate 105 so as to be cut and aligned by the cutter 104.

The circular rib R and tubular cloth C are fed into the needle drop point 100 in the state of passing through the upper side and under side on both sides of the front rollers 101, 102 along with the operation of the sewing machine. At this time, the tubular cloth C is corrected of its end portion position by compression between the cloth end control roller 106 and a cloth end correction roller (not shown) disposed separatably opposite to the cloth end control roller 106, and its end portion is sewn into the circular rib R while being cut and aligned by the cutter 104. When sewing is advanced and the sewing start portion reaches the front rollers 101, 102, these rollers 101, 102 are set aside in a direction orthogonal to the cloth feed direction a as indicated by arrows Z1, Z2 in FIG. 7, while a cloth stretching roller (not shown) provided beneath the bed of the sewing machine is moved from inside of the circular rib R, so that the circular rib R is stretched again to the girth dimension of the tubular cloth C so as to be sewn completely on the whole circumference.

In the conventional sewing apparatus of circular rib having such constitution and working mode, however, when the sewing start portion reaches the front rollers 101, 102, the front rollers 101, 102 supporting the circular rib R are set aside in the directions x1, x2 orthogonal to the cloth feed direction a, and then the peripheral length of the circular rib R is shorter than the peripheral length of the tubular cloth C applied without being stretched to the girth dimension, and therefore the circular rib R cannot be sewn to the tubular cloth C as specified. Accordingly, when the sewing start portion reaches the rollers 101, 102, the operation of the sewing machine is stopped temporarily, and in this state the circular rib R is stretched to the girth dimension of the tubular cloth C by the movement of the cloth stretching roller, and then the sewing machine must be operated again to sew the final portion.

Besides, since the cutter 104 is located in front of the needle drop point 100, if the sewing machine is operated in the state in which the tubular cloth C is set so that its end portion may overlap with the end portion of the circular rib R in the needle drop point 100, the end portion of the tubular cloth C from the needle drop point 100 to the cutter 104 is sewn into the end portion of the circular rib R before the end portion of the tubular cloth C is cut and aligned by the cutter 104, so that the appearance of the product is impaired.

Moreover, owing to the structure of correcting the position of the cloth end portion by holding the tubular cloth C by the cloth end control roller 106, and cloth end correction roller (not shown) disposed at a position opposite to the cloth end control roller 106 so as to act to compress the cloth end control roller 106 from the vertical direction to the support surface of the cover 107, if there is a step at the tubular cloth surface, it is necessary to adjust the position of the cloth end correction roller relative to the cloth end control roller 106 and adjust the compressing force by the both rollers depending on the thickness of the step, but this adjustment is difficult, and, as a result, the position deviation of the end portion of the tubular cloth C may not be corrected smoothly, or the compressive force may be excessive and the cloth may be damaged.

SUMMARY OF THE INVENTION

It is hence an object of the invention to provide a sewing apparatus of circular rib capable of supporting both a tubular cloth and a circular rib in a stretched state to the girth dimension of tubular cloth, and sewing the circular rib accurately and neatly into the tubular cloth without temporarily stopping the sewing machine operation during sewing.

To achieve the object, the sewing apparatus of circular rib of the invention comprises:

plural rollers disposed in front and rear of the needle drop point of a sewing machine, capable of applying and setting the circular rib in a position for passing over the needle drop point in a state with a peripheral direction of the circular rib matched with a cloth feed direction of the sewing machine, and a cloth correcting device for correcting a position of an end portion of a tubular cloth set on the plural rollers relatively to the circular rib, wherein said cloth correcting device comprises first cloth end position controlling means for gripping the end portion of the tubular cloth and correcting its position, so as to support the circular rib and tubular cloth in a state separated to the right and left at the front roller in front of the needle drop point, second cloth end position controlling means for gripping the end portion of the tubular cloth and correcting its position, so that the end portion of the tubular cloth may overlap with the circular rib between the needle drop point and the front roller, and a rib detaching guide disposed near the second cloth end position controlling means, the rib detaching guide being movable between an action position for supporting the circular rib above the tubular cloth on a sewing line, and a waiting position for allowing passing of a sewing start portion along with approach of the sewing start position.

According to the invention having such features, in the sewing process, the position of the end portion of the tubular cloth is corrected by the action of the first cloth end position controlling means and the end portions of the circular rib and tubular cloth are supported in a right and left separated state at the front roller. The position of the end portion of the tubular cloth is corrected by the operation of the second cloth end position controlling means and the end portion of the tubular cloth is guided so as to overlap at the lower side of the circular rib end portion supported at a higher position than the tubular cloth by the rib detaching guide. Moreover, as the sewing start portions of the circular rib and tubular cloth approach, the rib detaching guide moves to the waiting position aside from the circular rib, and sewing is continued while the circular rib and tubular cloth are stretched so the girth dimension of the tubular cloth. As a result, without having to stop the operation of the sewing machine temporarily while sewing, it is effective to sew the circular rib to the tubular cloth accurately and efficiently, without forming wrinkles or the like.

Other objects and effects of the invention will be clarified in the embodiments described below.

PREFERRED EMBODIMENTS OF THE INVENTION

Figure 1:
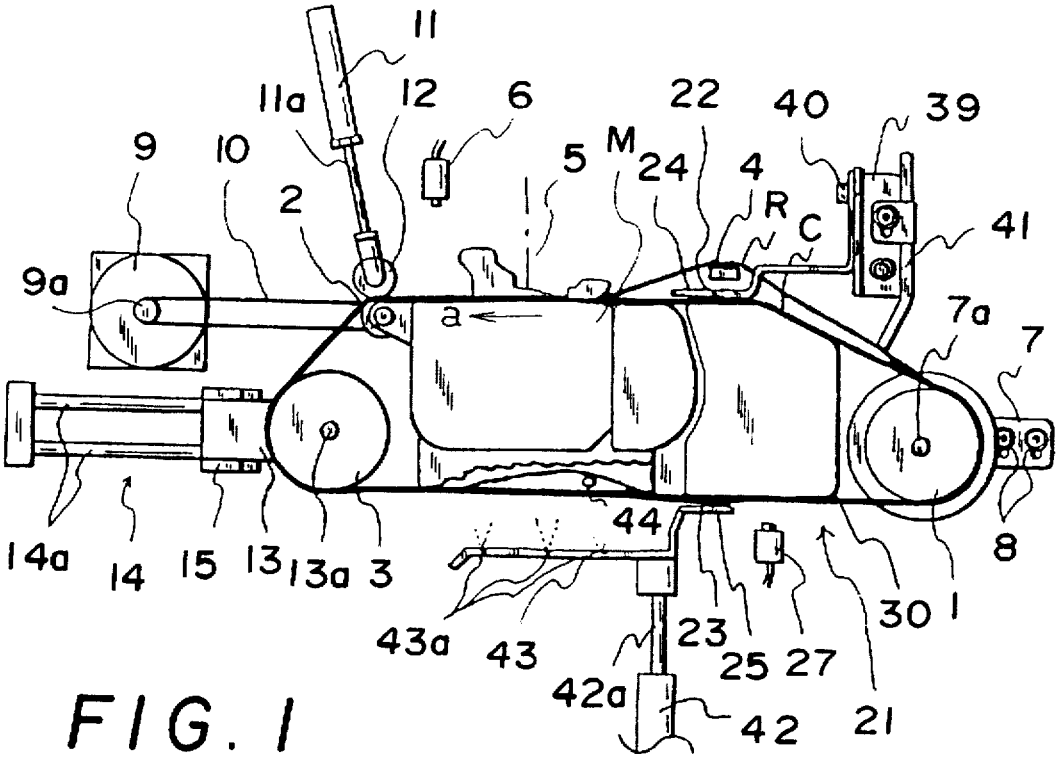
FIG. 1 is a schematic side view of an entire sewing apparatus of circular rib according to the invention.

Referring now to the drawings, preferred embodiments of the invention are described below.

FIG. 1 shows an entire sewing apparatus of circular rib of the invention. The setting units of the sewing object comprises a front roller 1, a rear roller 2, a rear cloth stretching roller 3, and a rib detaching guide 4. A circular rib R in a tape form is provided with a specific tension, and is applied and set in the members 1 to 4 at the position of passing through the needle drop point 5 of the bed M of the sewing machine, with its peripheral direction matched with the cloth feed direction a of the sewing machine. A set detection sensor 6 for detecting completion of setting of the circular rib R is provided in an upper part near the needle drop point 5 of the bed M of the sewing machine.

The front roller 1 is disposed so that its peripheral end portion may be positioned nearly on the same plane as the lower surface of the bed M of the sewing machine, in front of the needle drop point 5, and is rotatably supported on a horizontal shaft 7*a* projected in a bracket 7. The bracket 7 is fixed so as to be adjustable in position in the vertical direction through a screw 8 at the cloth send-in side from the bed M of the sewing machine, and the horizontal shaft 7*a* projecting on the bracket 7 is extended in the horizontal direction orthogonal to the cloth feeding direction a. Although not shown in the embodiment, it is preferred to dispose a member of a large frictional coefficient on the circumference of the front roller 1 so that the circular rib R before sewing and the tubular cloth C may not be overlap with each other by sliding and moving in a direction orthogonal to the cloth feeding direction a on the circumference of the front roller 1 during sewing by the operation of the sewing machine.

The rear roller 2 is disposed so that its peripheral upper end portion may be positioned nearly on a same plane as the upper surface of the bed M of the sewing machine, behind the needle drop point 5, and is linked and coupled to an output shaft 9*a* of an independent driving motor 9 operating regardless of the driving source of the sewing machine through an endless belt 10. This rear roller 2 makes a pair with a free feed roller 12 moving vertically by operation of a piston rod 11*a* projecting downward from a cylinder 11 disposed above the cloth send-out side from the bed M of the sewing machine, and the circular rib R and tubular cloth C are gripped by the free feed roller 12 and rear roller 2, so that the circular rib R and tubular cloth C are sent out by force in the cloth feeding direction a by the driving rotation of the rear roller 2 through the driving motor 9. In the embodiment, the rear roller 2 side is linked and coupled to the independent driving motor 9, but, alternatively, the free feed roller 12 side may be linked and coupled to the driving motor 9, and the rear roller 2 may be composed so as to be free to follow and rotate.

The rear cloth stretching roller 3 is disposed near the rear roller 2, behind the needle drop point 5, so that its peripheral lower end portion may be positioned nearly on a same plane as the lower surface of the bed M of the sewing machine, and is rotatably supported on a horizontal shaft 13*a* projecting on a support member 13. The support member 13 is fixed on a sliding member 15 slidably supported by a rod-less cylinder 14 disposed at the cloth send-out side from the bed M of the sewing machine, and the sliding member 15 moves back and forth in the horizontal direction matching with the cloth feeding direction a by supplying and discharging air in a pair of pipes 14*a*. Although not shown in the embodiment, it is preferred to install a stopper member in the moving route of the sliding member 15 so that the circular rib R may be supported by stretching to the girth dimension of the tubular cloth C, and it is further desired that the stopper member may be changeable in position so as to be adjustable according to the girth dimension of the tubular cloth C.

Figure 2:
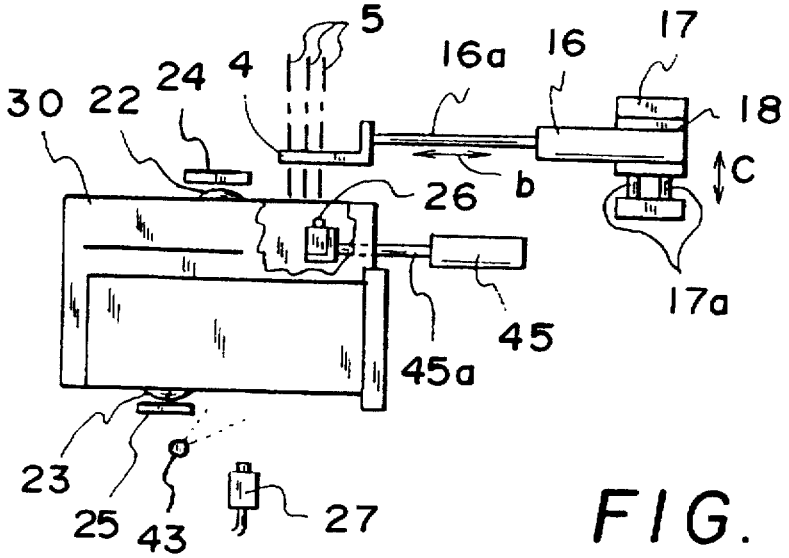
FIG. 2 is a partially cut-away front view of the same apparatus as shown in FIG. 1.
Figure 5:
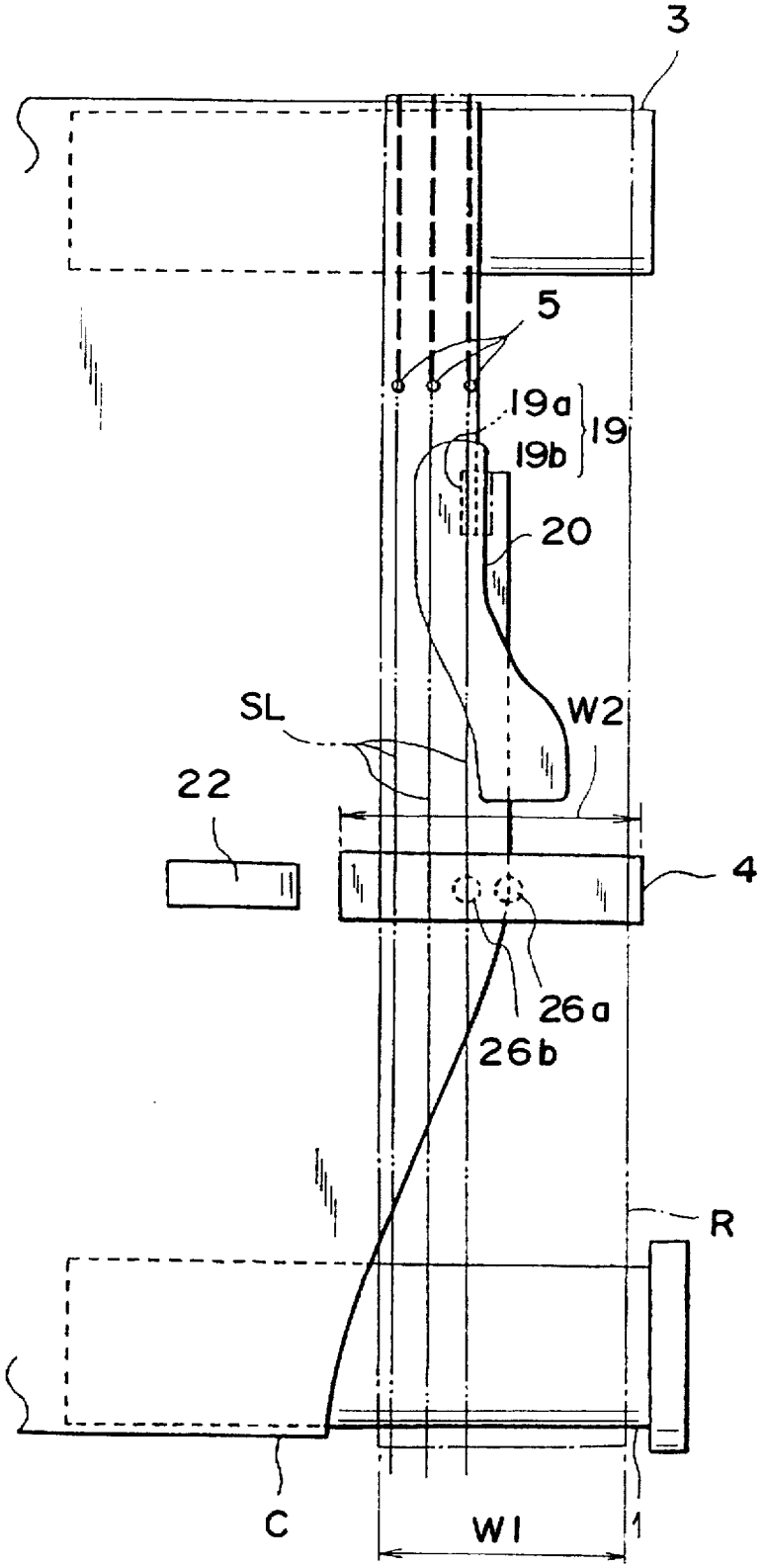
FIG. 5 is a magnified plan view of essential part of the sewing apparatus of circular rib of the invention.

The rib detaching guide 4 is disposed above the upper surface of the bed M of the sewing machine in front of the needle drop point 5. This rib detaching guide 4 is fixed, as shown in FIG. 2, to the leading end of the piston rod 16*a* projecting leftward from a cylinder 16 and moving leftward and rightward along the horizontal direction b orthogonal to the cloth feeding direction a. This cylinder 16 is fixed to a sliding member 18 supported slidably in the vertical direction c along a rod-less cylinder 17 disposed at the right side of the base side of the bed M of the machine about the virtual sewing line SL (see FIG. 5), and this sliding member 18 ascends and descends in the vertical direction c by supplying and discharging air in a pair of pipes 17*a*. That is, the rib detaching guide 4 moves between two positions, namely as shown in FIG. 2 and FIG. 5, the action position for supporting the circular rib R by projecting to a position spaced upward slightly from the upper surface of the bed M of the sewing machine, at the position from above the virtual sewing line SL passing over the needle drop point 5 to the right side of the sewing line SL, and the waiting position for allowing the downward move approaching the upper surface of the bed M of the sewing machine along with descent of the sliding member 18, and passing of the sewing start portion by setting aside from the action position by the retreating move to the rightward position of the bed M of the sewing machine of the piston rod 16*a* of the cylinder 16. Incidentally, the width w2 of the rib detaching guide 4 is formed slightly larger than the width w1 of the circular rib R in a tape form.

As shown in FIG. 5, in front of the needle drop point 5, a cutting device composed of a cutter 19 for cutting and aligning the end portion of the tubular cloth C is disposed. This cutter 19 is composed of a fixed blade 19*a* having an edge fixed on a same plane as the upper surface of the bed M of the sewing machine, and a movable blade 19*b* of a scythe form having an edge crossing with the edge of the fixed blade 19*a*. The movable blade 19*b* is synchronized with the driving of the sewing machine, moves upward and downward and appears from the upper surface of said bed M by the upward movement. A cloth guide member 20 is disposed at position corresponding to the cutter 19. This cloth guide member 20 is to form a passing channel of the end portion of the tubular cloth C against the upper surface of the bed M of the sewing machine, and this channel is formed in a proper size so as not to cause corrugation when cutting off, through the end edge is cut off by the cutter 19 when the end portion of the tubular cloth C passes through.

At an intermediate position between the bed M of the sewing machine and the front roller 1, a cloth correcting device 21 is disposed. This cloth correcting device 21 is composed of second cloth end position controlling means mainly comprising a cloth end control roller 22, a roller holder (holding member) 24, a cloth end detector 26, and a stepping motor 28 (see FIG. 4) linked and coupled to a rotary shaft 22*a* of the cloth end control roller 22, first cloth end position controlling means mainly comprising a cloth end control roller 23, a roller holder (holding member) 25, a cloth end detector 27, and a stepping motor 29 (see FIG. 4) linked and coupled to a rotary shaft 23*a* of the cloth end control roller 23, and the rib detaching guide 4 described above.

Figure 3:
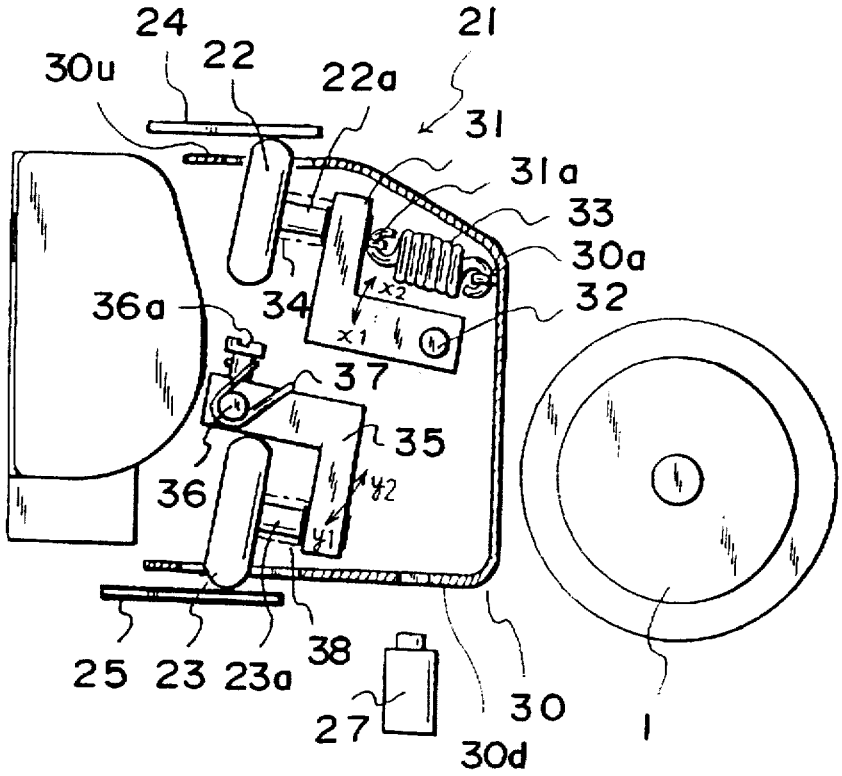
FIG. 3 is a magnified longitudinal side view of a cloth correcting device as an essential part of the same apparatus as shown in FIG. 1.
Figure 4:
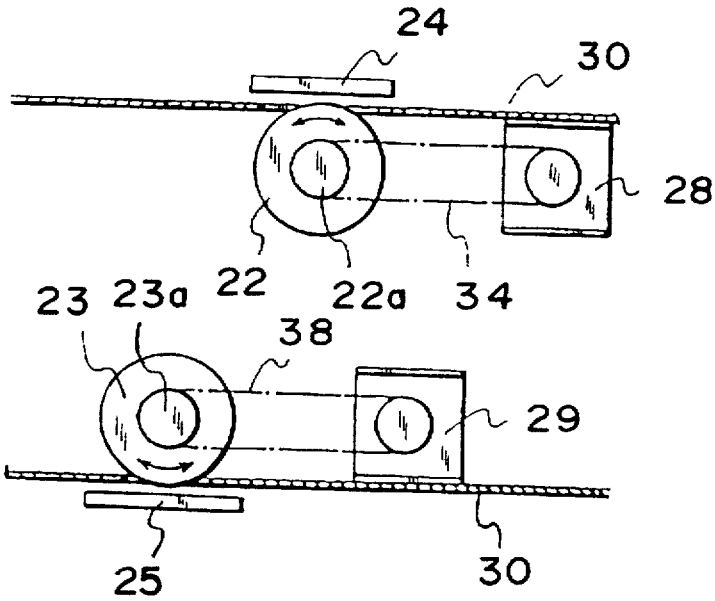
FIG. 4 is a magnified longitudinal front view of the same cloth correcting device as shown in FIG. 3.

The cloth end control roller 22 in the second cloth end position controlling means is, as shown in FIG. 3 and FIG. 4, disposed at the left side of the free end of the bed M of the sewing machine about the virtual sewing line SL, and at a position where part of the outer circumference of the cloth end control roller 22 may be exposed above from the cloth passing plane formed by the outer surface of a cover 30. The rotary shaft 22*a* of the cloth end control roller 22 is inclined to the upper surface 30*u* of the cover 30 at the horizontal plane, being parallel to the cloth feeding direction a, and this inclined rotary shaft 22*a* is rotatably supported on an L-shaped angle. This L-shaped angle 31 is rotatably supported in the direction of arrow x1–x2 about a support shaft 32 disposed along the horizontal direction orthogonal to the cloth feed direction a. This support shaft 32 is disposed beneath the plane linking the peripheral upper end portion of the front roller 1 and the peripheral upper end portion of the cloth end control roller 22, and at the cloth send-in side to the cloth end control roller 22. The L-shaped angle 31 is provided with a tension coil spring 33 for elastically rotating and thrusting in the direction of arrow x2 opposite to the direction of arrow x1 of the cloth feed direction about the support shaft 32. This tension coil spring 33 is arrested at a protrusion 30*a* formed on the inner surface of the cover 30 at its one end, and at a protrusion 31*a* of the L-shaped angle 31 at other end. The rotary shaft 22*a* of the cloth end control roller 22 is linked and coupled to the stepping motor 28 through an endless belt 34. In the embodiment, although not shown, the cloth end control roller 22 has a member of a large coefficient of friction, such as O-ring at its peripheral edge, and this member is preferred to be disposed rotatably about the circular axis along the peripheral edge.

The cloth end control roller 23 in the first cloth end position controlling means is disposed, as shown in FIG. 3 and FIG. 4, so that part of outer circumference of the cloth end control roller 23 may be located so as to be exposed downward from the cloth passing surface formed by the outer surface of the cover 30 and come to the left side of the bed M of the sewing machine about the virtual sewing line SL. The rotary shaft 23*a* of the cloth end control roller 23 is inclined toward the lower surface 30*d* of the cover 30 parallel and horizontal to the cloth feed direction a, and the inclined rotary shaft 23*a* is rotatably supported on an L-shaped angle 35. This L-shaped angle 35 is supported rotatably in the direction of arrow y1–y2 about a support shaft 36 disposed along the horizontal direction orthogonal to the cloth feed direction a. This support shaft 36 is disposed at the rear side of the cloth feed direction relative to the cloth end control roller 23 at the position near the perpendicular direction passing the peripheral lower end of the cloth end control roller 23 and above the plane linking the peripheral lower end of the front roller 1 and the peripheral lower end of the cloth end control roller 23. This L-shaped angle 35 is furnished with a torsion coil spring 37 for elastically rotating and thrusting in the direction of arrow y1 opposite to the direction of arrow y2 in the cloth feed direction about the support shaft 36. One end of the torsion coil spring 36 is wound on a protruding screw 36*a* formed on the support shaft 36, and the other end is wound on the L-shaped angle 35. The rotary shaft 23*a* of the cloth end control roller 23 is linked and coupled to the stepping motor 29 through an endless belt 38. In the embodiment, the support shaft 36 is disposed at the rear side of the cloth feed direction relative to the cloth end control roller 23 at the position near the perpendicular direction passing the peripheral lower end of the cloth end control roller 23 and above the plane linking the peripheral lower end of the front roller 1 and the peripheral lower end of the cloth end control roller 23, but not limited to this, however, it may be disposed only within a range at the rear side of the cloth send-in side relative to the cloth end control roller 23 and above the plane linking the peripheral lower end of the front roller 1 and peripheral lower end of the cloth end control roller 23. Although not shown in the embodiment, preferably, the cloth end control roller 23 should have a member larger in frictional coefficient such as O-ring at the peripheral edge, and this member should be disposed rotatably about a circular shaft along the peripheral edge.

The roller holder 24 in the second cloth end position controlling means is, as shown in FIG. 1, composed of an angle member of nearly L shape. The roller holder 24 is disposed so that the guide surface side at its one end may be located at the left side along the direction orthogonal to the cloth feed direction a relative to the rib detaching guide 4 above and near the cloth end control roller 22, and the other end is fixed by a bracket 39 through a screw 40. This bracket 39 is fitted to the front end of a rotary arm (not shown) extending in the direction orthogonal to the cloth feed direction a, and the roller holder 24 is rotated vertically by the operation of the air cylinder and others. That is, the roller holder 24 is designed to contact with or depart from the cloth end control roller 22, and be fixed at action position and non-action position, and when the roller holder 24 is at the action position, the end of the tubular cloth C is gripped by the roller holder 24 and the cloth end control roller 22. The bracket 39 is provided with an air nozzle 41, and by blowing compressed air from the air nozzle 41 toward the end of the tubular cloth C, curling of the cloth end is prevented.

In the second cloth end position controlling means composed of the cloth end control roller 22 and roller holder 24 in such constitution, when the step portion of the tubular cloth C passes through between the roller holder 24 and cloth end control roller 22, the L-shaped angle 31 for supporting the cloth end control roller 22 rotates about the support shaft 32 in the direction of arrow x1 in the cloth feed direction with resisting the elastic rotary thrusting force of the tension coil spring 33 dependent on the size of the step portion along with the progress of the step portion in the cloth feed direction. By this rotation, consequently, the gap between the cloth end control roller 22 and roller holder 24 changes automatically and appropriately depending on the thickness of the step portion of the tubular cloth C to allow passing of the end portion, and even during such automatic change of the interval, the peripheral surface of the cloth end control roller 22 is compressed to the tubular cloth C, and keeps gripping the end of the tubular cloth C together with the roller holder 24, thereby acting to correct position deviation of the cloth end in the direction intersecting the cloth feed direction a.

The roller holder 25 in the first cloth end position controlling means is, as shown in FIG. 1, disposed so that the guide surface at its one end may be located below the cloth end control roller 23, and the other end is fixed to the leading end of a piston rod 42*a* projecting upward from a cylinder 42 and moving upward and downward in the perpendicular direction. That is, the roller holder 25 moves between the action position to contact with the cloth end control roller 23 and the non-action position to depart therefrom. When the roller holder 25 is at the action position, the end of the tubular cloth C is gripped by the roller holder 25 and the cloth end control roller 23.

In the first cloth end position controlling means composed of the cloth end control roller 23 and roller holder 25 in such constitution, when the step portion of the tubular cloth C passes through between the roller holder 25 and cloth end control roller 23, the L-shaped angle 35 for supporting the cloth end control roller 23 rotates about the support shaft 36 in the direction of arrow y2 in the cloth feed direction with resisting the elastic rotary thrusting force of the torsion coil spring 37 dependent on the size of the step portion along with the progress of the step portion in the cloth feed direction. By this rotation, consequently, the gap between the cloth end control roller 23 and roller holder 25 changes automatically and appropriately depending on the thickness of the step portion of the tubular cloth C to allow passing of the end portion, and even during such automatic change of the interval, the peripheral surface of the cloth end control roller 23 is compressed to the tubular cloth C, and keeps gripping the end of the tubular cloth C together with the roller holder 25, thereby acting to correct position of the cloth end in the direction intersecting the cloth feed direction a.

At the leading end of a piston rod 42*a* of the cylinder 42, an air nozzle 43 extending in the direction matching with the cloth feed direction is provided, and multiple air injection holes 43*a* are formed in a row in the air nozzle 43. Compressed air is injected upward from the air injection holes 43*a* of the air nozzle 43, and the compressed air is blown against the drooping portion of the set tubular cloth C, and the portion of the tubular cloth C is lifted above the circular rib R, and is located above a seam detecting lever 44 positioned at a position along the plane linking the front roller 1 and the peripheral lower end of the rear cloth stretching roller 3. That is, the portion of the tubular cloth C is located at the upward side across the seam detecting lever 44 relative to the circular rib R. This seam detecting lever 44 detects arrival of sewing start portion of the circular rib R and tubular cloth C, and the seam detecting lever 44 detecting the arrival of the sewing start portion retreats gradually in a direction intersecting the cloth feed direction a along with the conveyance of the sewing start portion. While retreating from the point of detection of arrival of sewing start portion, a passing signal telling passing of the sewing start portion is being generated continuously, and along with generation of this passing signal, it is composed to generate a count signal for counting the control action timing as described below to the rib detaching guide 4 and cloth end detector 26.

The cloth end detector 26 in the second cloth end position controlling means is composed of a reflection type photo detector, and is disposed in the cloth correcting device 21 beneath the rib detaching guide 4 at the action position. This cloth end detector 26 is fixed to the leading end of a piston rod 45*a* projecting leftward from a cylinder 45 and moving leftward and rightward along the horizontal direction b orthogonal to the cloth feed direction a as shown in FIG. 2, and along with the operation of the cylinder 45, by moving the cloth end detector 26 in the horizontal direction orthogonal to the cloth feed direction a, the position of the cloth end detector 26 can be changed over between a first position (see 26*b* in FIG. 5) on a cutting line parallel to the cloth feed direction a passing through the cutter 19, and a second position (see 26*a* in FIG. 5) remote from the cutting line in a direction orthogonal to the cloth feed direction a. The cloth end detector 26 detects the end portion of the tubular cloth C at both positions 26*b*, 26*a*. That is, when cutting the end portion of the tubular cloth C by the cutter 19, the cloth end detector 26 is moved to the second position 26*a* at the right side of the cutting line as shown in FIG. 5, and when not cutting the end portion of the tubular cloth C, the cloth end detector 26 is moved to the first position 26*b* on the cutting line.

When, as shown in FIG. 4, the cloth end detector 26 detects the end portion of the tubular cloth C in the state of gripping the end portion of the tubular cloth (not shown) by the roller holder 24 and cloth end control roller 22, a correction signal for rotating the cloth end control roller 22 by one step in the counterclockwise direction in the front view is transmitted to the stepping motor 28, and when the end portion of the tubular cloth C is not detected, to the contrary, a correction signal for rotating the cloth end control roller 22 by one step in the clockwise direction in the front view is transmitted to the stepping motor 28. This cloth end detection by the cloth end detector 26 is done sequentially, and by the correction signal generated along with the detection, the tubular cloth C moves in the direction intersecting the cloth feed direction a by the extent corresponding to one-step rotation, and the position is corrected so that the end portion of the tubular cloth C may match with the direction along the cloth feed direction a passing through the detection position of the cloth end detector 26.

A cloth end detector 27 of the first cloth end position controlling means is located beneath the cloth correcting device 21 and at the left side of the left end of the set circular rib R, and this cloth end detector 27 is composed of a reflection type photo detector. As shown in FIG. 4, when the cloth end detector 27 detects the end portion of the tubular cloth C in the state of gripping the end portion of the tubular cloth (not shown) by the roller holder 25 and cloth end control roller 23, a correction signal for rotating the cloth end control roller 23 by one step in the clockwise direction in the front view is transmitted to the stepping motor 29, and when the end portion of the tubular cloth C is not detected, to the contrary, a correction signal for rotating the cloth end control roller 23 by one step in the counterclockwise direction in the front view is transmitted to the stepping motor 29. This cloth end detection by the cloth end detector 27 is done sequentially, and by the correction signal generated along with the detection, the tubular cloth C moves in the direction intersecting the cloth feed direction a by the extent corresponding to one-step rotation, and the position is corrected so that the circular rib R and tubular cloth C may not overlap each other on the front roller 1. In the embodiment, although not shown, it is preferred to be designed so as to move the cloth end detector 27 downward when setting the circular rib R and tubular cloth C so as not to impede the setting.

Figure 6:
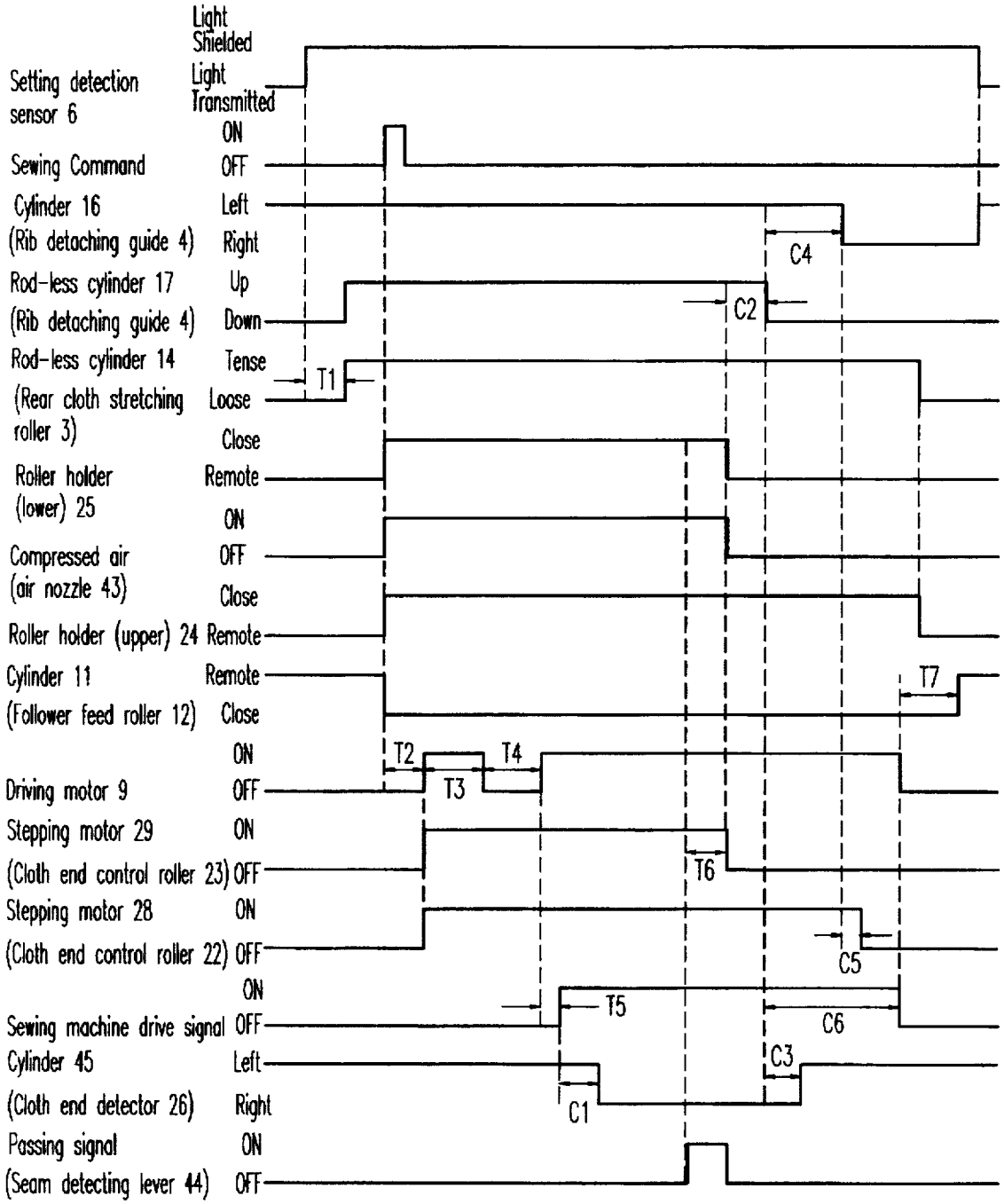
FIG. 6 is a timing chart for explaining the operation of the invention.
Figure 7:
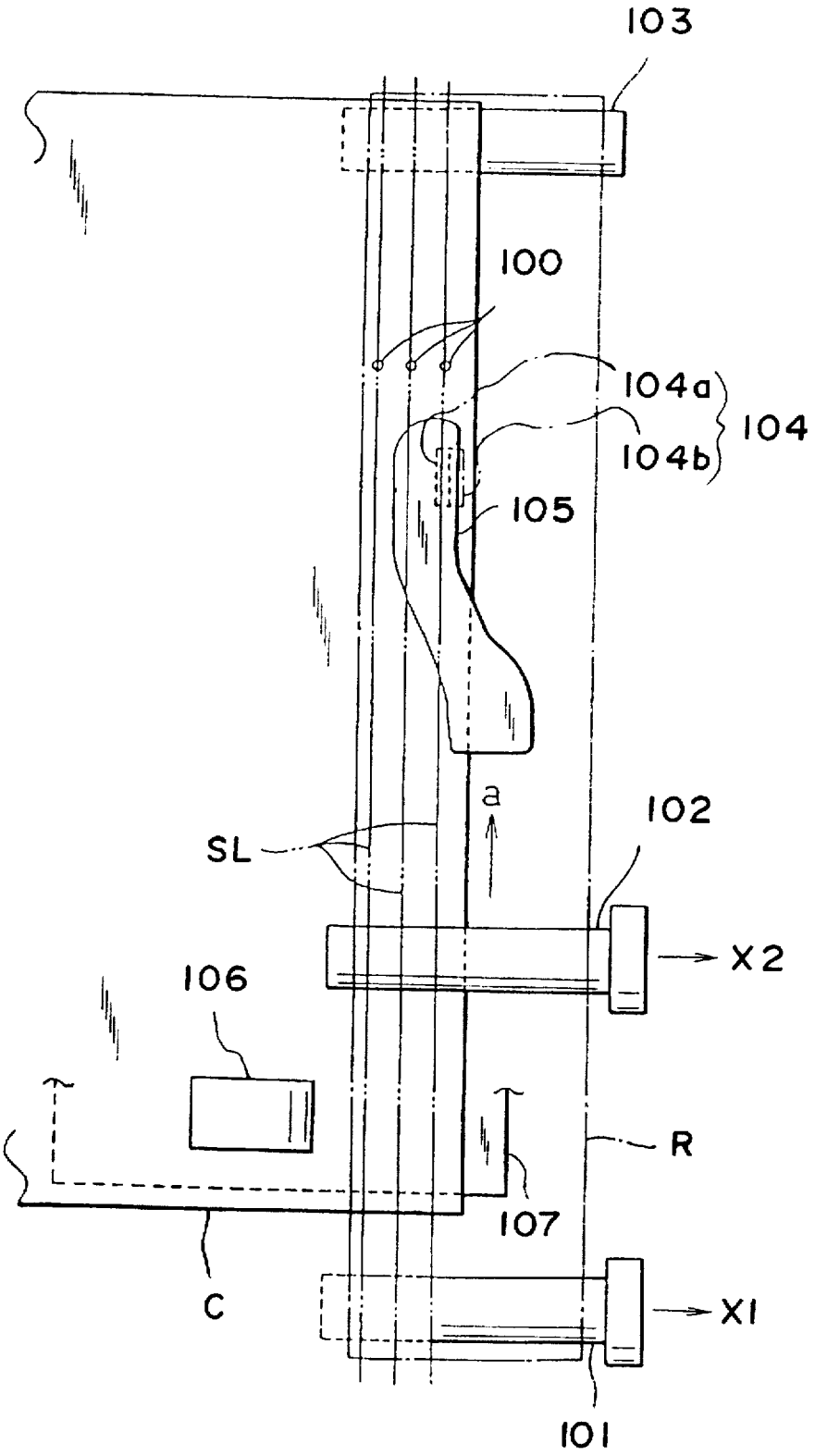
FIG. 7 (PRIOR ART)
FIG. 7 is a magnified plan view of essential part of a conventional sewing apparatus of circular rib.

The sewing operation by the circular rib sewing apparatus in such constitution is described below by referring to the timing chart in FIG. 6.

Prior to operation of the sewing apparatus, the sewing operator applies and sets the circular rib R in the front roller 1, rear roller 2, rear cloth stretching roller 3, and rib detaching guide 4 so that the circular rib R may pass through the needle drop point 5. Successively, the tubular cloth C is applied and sets in the same members as in the case of the circular rib R so as to overlap its end portion with the end portion of the circular rib R in the needle drop point 5. Upon lapse of time T1 after detection (light shielded state) of such application and setting of the circular rib R by the setting detection sensor 6, the rear cloth stretching roller 3 close to the bed M of the sewing machine is moved to the position remote from the bed M of the sewing machine by the operation of the rod-less cylinder 14, and the rib detaching guide 4 is moved to the action position slightly apart upward from the position close to the upper surface of the bed of the sewing machine by the operation of the rod-less cylinder 17. This operation after time T1 is preferably done after setting the tubular cloth C in the members.

In thus set state of circular rib R and tubular cloth C, for example, by manipulating a pedal switch or the like, a sewing command is issued, and simultaneously with the sewing command, in order to grip the tubular cloth C and guide in the direction intersecting the cloth feed direction a, the roller holders 24, 25 are moved to the individual action positions, and the free feed roller 12 is moved to the position close to the rear roller 2 by the action of the cylinder 11, and compressed air is injected from the air nozzle 43. By the injection of compressed air from the air nozzle 43, the end portion of the tubular cloth C at the lower side of the bed M of the sewing machine is, as shown in FIG. 1, lifted above the lower surface of the bed M of the sewing machine, and is located above the seam detecting lever 44. By holding this state, the sewing start portion of the tubular cloth C to be sewn into the inner side of the circular rib R is detected by the seam detecting lever 44.

Upon lapse of time T2 after issue of the sewing command, the driving motor 9 is operated for time T3, and the stepping motor 28 drives and rotates the cloth end control roller 22 by the correction signal issued by detection by the cloth end detector 26 disposed at position **26*b* on the cutting line. By this driving and rotation of the cloth end control roller 22, the end portion of the tubular cloth C is guided along the cloth end detector 26 disposed at the position 26*b*, so that the end portion of the tubular cloth C may not be cut off by the cutter 19 upon start of sewing. At the same time, during time T3, the stepping motor 29 drives and rotates the cloth end control roller 23 by the correction signal generated by detection of the cloth end detector 27, and by this driving and rotation of the cloth end control roller 23, the end portion of the tubular cloth C is guided so as not to overlap with the circular rib R on the front roller 1. That is, as shown in FIG. 5, by the operation of the driving motor 9 and driving and rotation of the cloth end control rollers 22, 23 by the stepping motors 28, 29, the circular rib R and tubular cloth C are supported in the state being separated to the right and left on the front roller 1 and so that the end portion of the tubular cloth C may not be cut off near the cutter 19. Besides, in the cloth end control roller 22, since the circular rib R is supported at a position above the tubular cloth C by the rib detaching guide 4 disposed above near the cloth end control roller 22, the tubular cloth C can be easily moved to the sewing position at the inner side of the end portion of the circular rib R by driving and rotation of the cloth end control roller 22 by the stepping motor 28**.

After the driving motor 9 is operated for time T3, time T4 is provided for lowering the presser foot, and after lapse of time T4, a driving signal of the sewing machine is generated and sewing is started. By the generation of the driving signal of sewing machine, sewing of the circular rib R and tubular cloth C is started, and when the number of stitches counted from the start point reaches C1 (several stitches corresponding to the distance for conveying the end portion of the tubular cloth C at least from the cutter 19 to the needle drop point 5), the cloth end detector 26 is moved from the position **26*b* on the cutting line to the position 26*a* at the right side of the cutting line by the operation of the cylinder 45. By this move of the cloth end detector 26, the end portion of the tubular cloth C is gradually guided into the cutter 19 side, and the end portion is cut off. That is, by designing so as not to cut off the end portion of the tubular cloth C by the cutter 19 upon start of sewing by the sewing machine, it is possible to eliminate the step difference between the uncut end portion of the tubular cloth C and the end portion of the tubular cloth C on the cutting portion for the circular rib R caused due to deviation of arrangement of the needle drop point 5 and cutter 19**.

In this way, as the sewing of circular rib R and tubular cloth C progresses, when the sewing start portion reaches the seam detecting lever 44, a passing signal telling passing of the sewing start portion is issued at this time. Upon lapse of time T6 after detection of passing signal of sewing start portion by the seam detecting lever 44, the roller holder 25 is moved to the position apart from the cloth end control roller 23 by the operation of the cylinder 42, and the stepping motor 29 is turned off, thereby stopping the driving and rotation of the cloth end control roller 23. Moreover, when the sewing start portion approaches the rib detaching guide 4 due to progress of sewing of the circular rib R and tubular cloth C, the end portion of the tubular cloth sewn into the circular rib R is gradually lifted to the rib detaching guide 4 side, and the tubular cloth C is guided in the state being gripped between the roller holder 24 and cloth end control roller 22. By this lifting of only the end portion side of the tubular cloth C, the end portion of the tubular cloth C being supported beneath the cloth guide member 20 is guided gradually above the cloth guide member 20, so that the end portion of the tubular cloth C may not be cut by the cutter 19.

When the number of stitches counted after the operation of the stepping motor 29 is turned off reaches C2, the rib detaching guide 4 is lowered and moved to the position close to the upper surface of the bed M of the sewing machine from the position remote from the upper surface of the bed M of the sewing machine by the operation of the rod-less cylinder 17. When the number of stitches counted from start of lowering of the rib detaching guide 4 reaches C3, the cloth end detector 26 is moved to the position **26*b* on the cutting line from the position 26*a* at the right side of the cutting line by the operation of the cylinder 45, and by this move of the cloth end detector 26, the end portion of the tubular cloth C is not cut by the cutter 19. That is, by designing so as not to cut the tubular cloth C by the cutter 19 at the end of sewing, the end portion of the tubular cloth C can be guided so as to go along the end portion of the tubular cloth C upon start of sewing, and therefore the end portion of the tubular cloth C sewn into the circular rib R upon completion of sewing is changed over in linear state. When the number of stitches counted from the start of lowering of the rib detaching guide 4 reaches C4, the rib detaching guide 4 is moved away to the right side waiting position at the base side of the bed M of the sewing machine from the action position located above the virtual sewing line SL by the operation of the cylinder 16, so as not to block passing of the sewing start portion approaching by the progress of sewing of circular rib R and tubular cloth C. When the number of stitches counted from start of operation of the cylinder 16 reaches C5, the operation of the stepping motor 28 is turned off, thereby stopping driving and rotation of the cloth end control roller 22**.

The sewing machine driving signal generated along with progress of sewing of circular rib R and tubular cloth C is stopped when the number of stitches counted from start of lowering move of the rib detaching guide 4 reaches C6. Within time T7 after stopping of the sewing machine driving signal, the thread is cut by a thread cutting device (not shown), and the presser foot is raised, so that sewing of circular rib R and tubular cloth C is over. Upon lapse of time T7 after stop of the sewing machine driving signal, the free roller 12 moves to the position remote from the rear roller 2 by the action of the cylinder 11. At this moment, the sewing object is taken out from the sewing apparatus, and finally removal of the sewing object is detected by the setting detection sensor 6 (light transmission state), and at the same time the rib detaching guide 4 is moved to the action position located on the virtual sewing line by the action of the cylinder 16 so as to be ready for the sewing object to be set next.

During operation of the embodiment based on the timing chart, when the step portion of the tubular cloth C passes through between the cloth end control rollers 22, 23 and roller holders 24, 25, the L-shaped angles 31, 35 for supporting the cloth end control rollers 22, 23 are guiding the end portion of the tubular cloth C in the direction intersecting the cloth feed direction a while rotating in the direction of arrows x1, y2 as the cloth feed direction, while resisting the rotary thrusting force, about the support shafts 32, 36 depending on the step portion of the tubular cloth C.

The entire disclosure of Japanese patent Application No. 8-146593 filed on May 15, 1996, including the specification, claims, drawings and summary are incorporated herein by reference in its entirety.

What is claimed is:

1. A sewing apparatus of circular rib comprising:

plural rollers disposed in front and rear of a needle drop point of a sewing machine, capable of applying and setting the circular rib in a position for passing over the needle drop point in a state with a peripheral direction of the circular rib matched with a cloth feed direction of the sewing machine, and a cloth correcting device for correcting a position of an end portion of a tubular cloth set on the plural rollers relatively to the circular rib, wherein said cloth correcting device comprises first cloth end position controlling means for gripping the end portion of the tubular cloth and correcting its position, so as to support the circular rib and tubular cloth in a state separated to the right and left at said front roller in front of the needle drop point, second cloth end position controlling means for gripping the end portion of the tubular cloth and correcting its position, so that the end portion of the tubular cloth may overlap with the circular rib between the needle drop point and said front roller, and a rib detaching guide disposed near the second cloth end position controlling means, the rib detaching guide being movable between an action position for supporting the circular rib above the tubular cloth on a sewing line, and a waiting position for allowing passing of a sewing start portion along with approach of the sewing start portion.

2. A sewing apparatus of circular rib of claim 1, wherein said sewing machine includes a cutting device for cutting the end portion of the tubular cloth, the cutting device being located in front of the needle drop point, and said second cloth end position controlling means includes a cloth end detector for detecting the end portion of the tubular cloth individually at a first position on a cutting line parallel to the cloth feed direction passing through the cutting device and at a second position remote from the cutting line, wherein the cloth end detector detects the end portion at the first position in the period of several stitches from start of sewing and in the period of several stitches before end of sewing.

3. A sewing apparatus of circular rib of claim 1 wherein both the first and second cloth end position controlling means includes;

a cloth end control roller for moving the cloth in a direction intersecting the cloth feed direction by contacting with the cloth, the cloth end control roller being elastically thrust in a reverse direction of the cloth feed direction and being rotatable about a shaft disposed in a horizontal direction orthogonal to the cloth feed direction, and a holding member disposed at a position for gripping and guiding the end portion of the tubular cloth together with the cloth end control roller.

4. A sewing apparatus of circular rib of claim 2, wherein both the first and second cloth end position controlling means includes:

a cloth end control roller for moving the cloth in a direction intersecting the cloth feed direction by contacting with the cloth, the cloth end control roller being elastically thrust in a reverse direction of the cloth feed direction and being rotatable about a shaft disposed in a horizontal direction orthogonal to the cloth feed direction, and a holding member disposed at a position for gripping and guiding the end portion of the tubular cloth together with the cloth end control roller.

* * * * *